US005855252A

United States Patent [19]

Vrolyks

[11] Patent Number: 5,855,252

[45] **Date of Patent: *Jan. 5, 1999**

[54] LADDER SAFETY ATTACHMENT

[76] Inventor: Jan William Vrolyks, P.O. Box 2607, Blue Jay, Calif. 92317

[ * ] Notice: Under 35 U.S.C. 154(b), the term of this patent shall be extended for 40 days.

[21] Appl. No.: 562,471

[22] Filed: Nov. 24, 1995

Related U.S. Application Data

[63] Continuation-in-part of Ser. No. 380,492, Jan. 30, 1995, abandoned.

[51] Int. Cl.[6] ..... E06C 7/14

[52] U.S. Cl. ..... 182/214; 182/107

[58] Field of Search ..... 182/107, 214; 139/80, 81

[56] References Cited

U.S. PATENT DOCUMENTS

| | | | |
|---|---|---|---|
| 467,468 | 1/1892 | Camp | 139/81 |
| 619,235 | 2/1899 | Schwarting | 135/80 |
| 2,327,317 | 8/1943 | Randall | 182/107 |
| 4,359,138 | 11/1982 | Kummerlin | 182/107 |
| 4,411,284 | 10/1983 | Opitz | 135/81 |

FOREIGN PATENT DOCUMENTS

| | | | |
|---|---|---|---|
| 178690 | 11/1953 | Germany | 135/81 |
| 2125282 | 3/1984 | United Kingdom | 135/81 |
| 880876 | 9/1988 | WIPO | 135/81 |

*Primary Examiner*—Alvin Chin-Shue
*Attorney, Agent, or Firm*—Jack C. Munro

[57] ABSTRACT

An attachment for the top end of the ladder that maintains the top end of the ladder away from a vertical wall surface against which the ladder would ordinarily rest. The attachment has a general U-shape forming a pair of spaced apart legs each of which are laterally spaced from a side edge of the ladder. Each of these legs terminate in foot pads with these foot pads including an impaling device. Each impaling device is designed to penetrate a short distance the vertical wall surface when the weight of the human being approaches the upper end of the ladder. Each foot pad section includes retraction structure to retract the impaling device prior to usage. The legs are adjustable in spacing relative to the ladder. The attachment is pivotable between a forwardly extending position and a rearwardly extending position. Locking devices lock the attachment onto a rung of the ladder.

6 Claims, 3 Drawing Sheets

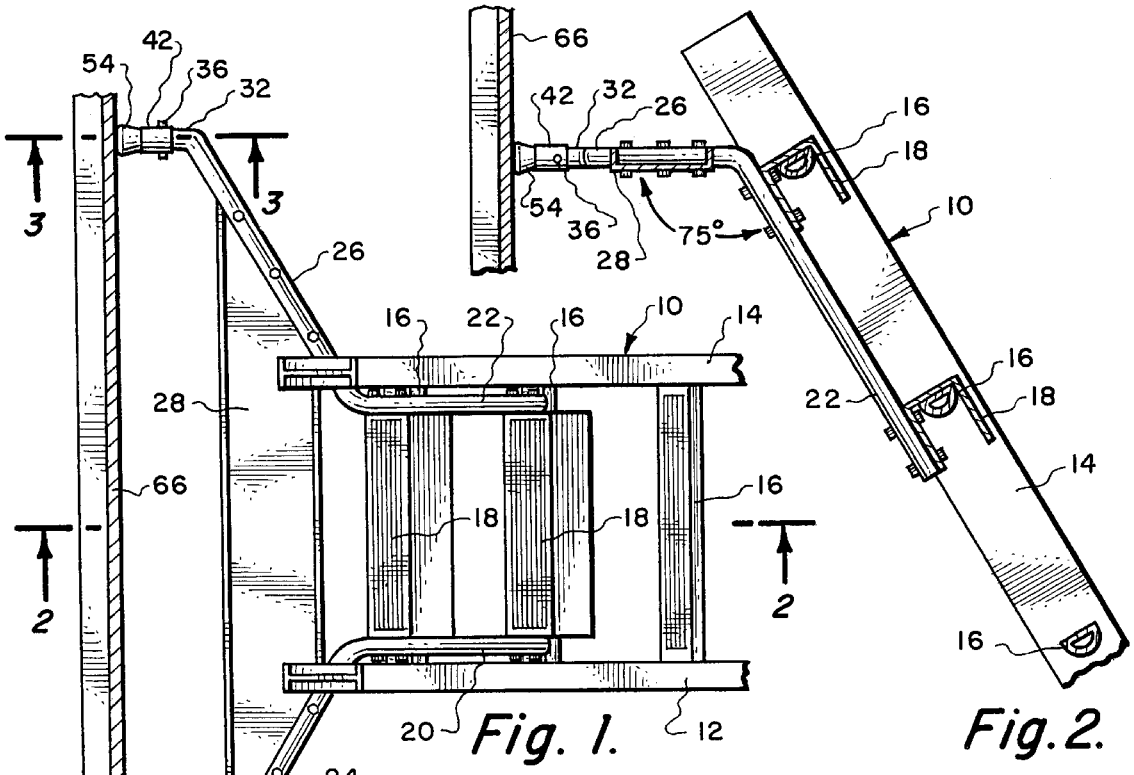
Fig. 1.
Fig. 2.
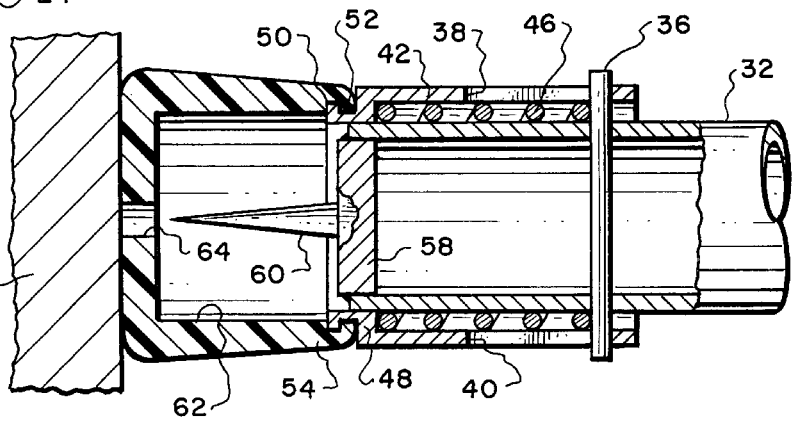
Fig. 3.
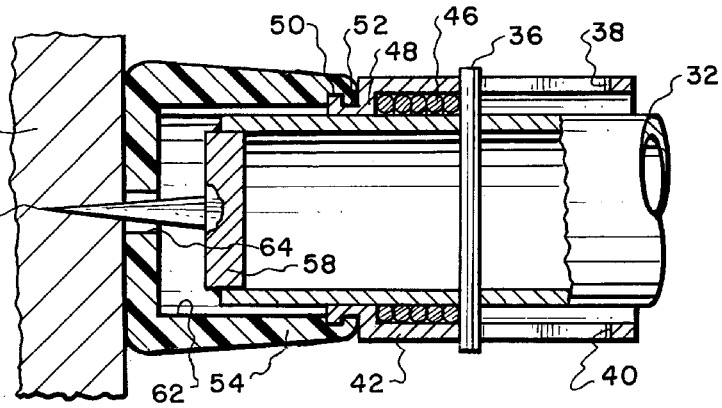
Fig. 4.

LADDER SAFETY ATTACHMENT

REFERENCE TO PRIOR APPLICATION

This application is a continuation-in-part of patent application Ser. No. 08/380,492, filed Jan. 30, 1995, abandoned by the same inventor.

BACKGROUND OF THE INVENTION

1. Field of the Invention

The field of this invention relates to an improvement to an attachment to the upper end of a ladder for stabilizing the ladder relative to a substantially vertical surface.

2. Description of the Prior Art

A ladder is commonly used to help people reach places they would not ordinarily reach. Ladders are often used to climb onto roofs of building and are used when washing windows or painting. In normal use, the bottom portion of the ladder rests on the ground or other similar horizontal surface and the upper end of the ladder typically leans against the vertical wall surface of a building or work surface. The ladder is oriented at an angle which makes it easy for a user to climb up and down the ladder and also aids in keeping the ladder from slipping.

The use of ladders in the United States is known to be a major cause of accidents each and every year. One problem with ladders is that there is lateral instability because the upper end of the ladder rests on the vertical surface with only the small width of the ladder defining the contact area with the vertical surface. When a person on the ladder and located at or near the upper ends extends laterally from the ladder when painting, cleaning or doing other type of work, the upper end of the ladder may be caused to slide along the vertical surface. This can cause the ladder and the person to fall to the horizontal supporting surface. Generally such falls cause injury to the person.

One of the problems with ladders is that their width is very narrow compared to their length which significantly increases the probability of lateral instability. Accordingly, it would be highly desirable to have a ladder that has a large lateral dimension in order to improve this lateral stability. However, significantly increasing the width of the ladder over its entire longitudinal length is not generally feasible since such increase in width will substantially increase not only the cost of manufacture but also decrease its portability by not facilitating being carried by a truck or other type of vehicle to the location of usage.

In order to increase the safety of operation of ladders, it has been common in the past to mount a ladder attachment to the upper end of the ladder. Typically such a ladder attachment is mounted on the uppermost rungs of the ladder and generally has a U-shaped configuration terminating in a pair of foot pad sections. The overall width between the foot pad sections is generally three to four times the width of the ladder. One foot pad section is laterally disposed a distance from one side edge of the ladder with the other foot pad section being disposed the same lateral distance from the opposite side of the ladder.

Generally these foot pad sections frictionally engage the wall surface and because of the increased lateral width, provide increased stability to the ladder minimizing the possibility of the ladder sliding on the vertical surface which can cause the person thereon to fall to the horizontal supporting surface. In the past these ladder attachments have been a significant improvement in the safety of ladders. However, these ladder attachments are not fail-safe and the upper end of the ladder can still slide on the vertical wall surface. Frequently this sliding is caused by the user himself who now feels the increased stability and therefore reaches even further laterally than one should until a sufficient imbalance is obtained and the ladder and the attachment both begin to slide.

Such ladder attachments in the past have not been designed to be adjustable. Adjustability is desired so the attachment will be usable in confined areas and also expandable to increased width in open areas. Also, adjustability is desired so the attachment will connect with different types of ladders. Also, it is desirable to lock the attachment to the ladder to prevent the attachment from falling free of the ladder during the time the ladder is moved. Such locking devices in the past have been quite complex requiring a lengthy installing procedure and have been expensive to manufacture, hence expensive to purchase by the user.

SUMMARY OF THE INVENTION

One of the primary objectives of the present invention is to provide a ladder attachment for the upper end of a ladder which substantially increases the safety of usage of the ladder.

Another objective of the present invention is to provide a ladder attachment which can be easily used on virtually any ladder in almost all situations.

Another objective of the present invention is to construct a safety ladder attachment which can be quickly and easily attached to the ladder without the need for permanent installing procedures eliminating the need for fasteners and tools.

Another objective of the present invention is to provide a safety ladder attachment which can be rapidly connected and disconnected to a ladder and may be positioned at any point along its longitudinal length.

Another objective of the present invention is to provide a safety attachment for a ladder which positively engages the vertical surface with which the ladder is associated, thereby providing a positive interconnection between the ladder attachment and the surface eliminating any sliding movement therebetween.

Another objective of the present invention is to construct a ladder attachment which can be quickly installed on all known types of ladders.

Another objective of the present invention is to construct a ladder attachment which is adjustable in width so the attachment can be used in confined areas and also increased in width for maximum effectiveness in open areas.

Another objective of the present invention is to construct a ladder attachment which is quickly and positively locked onto any known ladder and where the locking mechanism adjusts to the size of the ladder rung on which it is mounted.

The ladder safety attachment of the present invention comprises basically a U-shaped frame with the free outer end of the U-shaped frame forming foot pad sections. Within each foot pad section there is an impaling spike with this impaling spike being positioned in a retracted position relative to the foot pad section prior to usage. Associated with each foot pad section is a coil spring. When the safety attachment is mounted on the upper rungs of the ladder and weight is applied to the ladder, as such would normally be the case when a person occupies the upper rungs of the ladder, this weight will cause the impaling spikes to protrude and penetrate the vertical surface upon which the ladder attachment rests. When the person's weight is removed from the upper end of the ladder, the impaling spikes will again be located in a retracted position. The ladder attachment also includes an article supporting platform providing for the support of paint cans, brushes and other similar types of articles. The U-shaped frame is pivotable between a forward extending position and a rearward extending position to accommodate to different types of ladders. The U-shaped frame is expandable to increase width in open areas of use and contractible to decrease width in confined areas of use. The attachment is locked onto any size ladder rung.

BRIEF DESCRIPTION OF THE DRAWING

FIG. 1 is a top plan view of the first embodiment of ladder safety attachment of the present invention showing such being mounted on a ladder with the ladder attachment resting against a vertical wall surface;

FIG. 2 is a cross-sectional view through the ladder and the ladder attachment of the present invention taken along line 2—2 of FIG. 1;

FIG. 3 is an enlarged cross-sectional view through one of the foot pad sections of the ladder safety attachment of the present invention taken along line 3—3 of FIG. 1 showing the impaling spike located in the retracted position;

FIG. 4 is a view similar to FIG. 3 but showing the impaling spike in the extended position penetrating the vertical wall surface;

DETAILED DESCRIPTION OF THE PREFERRED EMBODIMENTS

Figures 5, 6, 9, 10, 11:
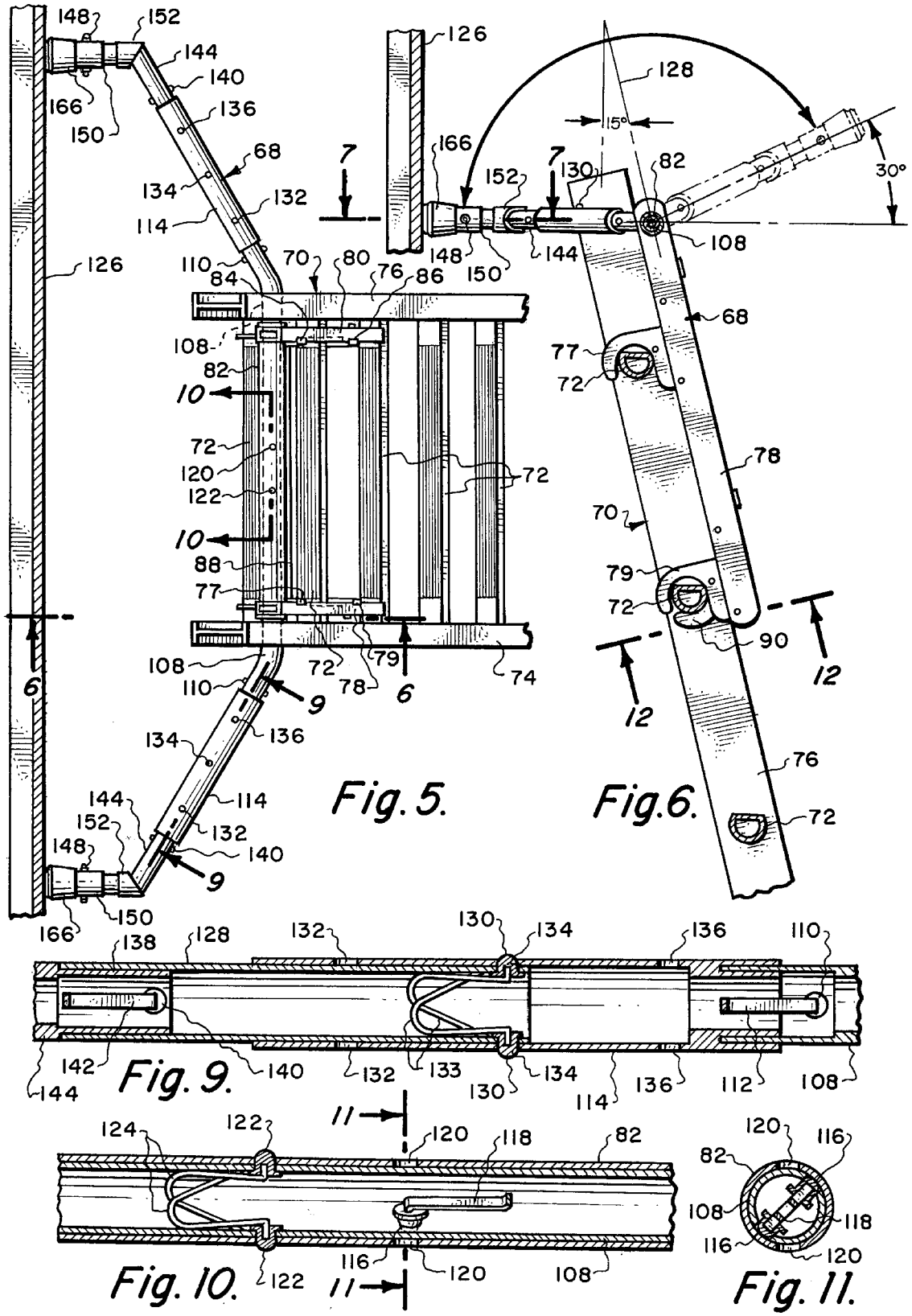
FIG. 5 is a top plan view of the second embodiment of the ladder safety attachment of the present invention again showing such being mounted on a ladder and with the ladder attachment resting against the vertical wall surface.
FIG. 6 is a cross sectional view through the ladder and the second embodiment of ladder attachment of the present invention taken along line 6—6 of FIG. 5.
FIG. 9 is a cross-sectional view taken along line 9—9 of FIG. 5 showing in more detail the arrangement of parts incorporated within the U-shaped frame of the second embodiment of ladder attachment of the present invention.
FIG. 10 is a cross-sectional view through the portion of the U-shaped frame that extends between the side rails of the ladder taken along line 10—10 of FIG. 5.
FIG. 11 is a cross-sectional view taken along line 11—11 of FIG. 10.

Referring particularly to FIGS. 1–4 of the drawings, there is shown the first embodiment of attachment of this invention mounted on a conventional ladder 10 which is formed of side rails 12 and 14 with a plurality of spaced apart rungs 16 connected therebetween. Resting on the uppermost rungs 16 of the ladder 10 are a pair of U-shaped plates 18. Plates 18 are fixedly secured between side members 20 and 22. Typical securement of members 20 and 22 would be by conventional bolt and nut type of fasteners. The side members 20 and 22 are located parallel to each other and the distance between the side members 20 and 22 is such that it is less than the distance between the side rails 12 and 14. Also, the spacing between the U-shaped plates 18 is such to be equal to the spacing between the rungs 16. One U-shaped plate 18 is to engage with the next to the uppermost rung 16 and the remaining plate 18 is to connect with the uppermost rung 16 as is clearly shown in FIG. 2 of the drawing.

Side member 20 is integrally connected to an outwardly flared member 24. In a similar manner, the side member 22 is integrally connected to an outwardly flared member 26. There is an angular relationship established between side member 20 and outwardly flared member 24 of about seventy-five degrees. Similar such seventy-five degrees is established between side member 22 and outwardly flared member 26. This seventy-five degree relationship is clearly shown in FIG. 2 of the drawing. The length of the outwardly flared members 24 and 26 would generally be about equal to the width of the ladder 10. However, this length can be increased and decreased without departing from the scope of this invention.

Fixedly mounted between the outwardly flared members 24 and 26 is a platform 28. The platform 28 will normally be made of metal or other similar type of rigid material, with the members 20, 22, 24 and 26 being formed of metallic tubing. Again, attachment of the platform 28 to the members 24 and 26 is to be accomplished by conventional bolt and nut fasteners. The platform 28 is to provide for the location of articles thereon such as spray cans, buckets, brushes and other tools.

Integrally connected to the outer end of outwardly flared member 24 is a leg member 30. A similar such leg member 32 is integrally connected to the outer end of outwardly flared member 26. Leg member 30 has a pin 34 transversely mounted therethrough, with each end of the pin 34 extending outwardly beyond the wall surface of the leg member 30. In a similar manner, a separate pin 36 is mounted in conjunction with the leg member 32. The ends of the pin 36 ride within slots 38 and 40, respectively, formed within a sleeve 42. Pin 34 also rides within slots (not shown) within a sleeve 44.

Surrounding the leg member 32 and located interiorly of the sleeve 42 is a coil spring 46. One end of the coil spring 46 abuts against the pin 36 with the opposite end of the coil spring 46 abutting against necked-down section 48 of the sleeve 42. Sleeve 44 will also include a similar necked-down section (not shown). Integrally connected to the necked-down section 48 is an attaching flange 50. The attaching flange 50 includes an annular groove 52. It is to be understood that the necked-down section of the sleeve 44 will similarly include a flange and groove both of which are not shown. Fixedly mounted in connection with the flange 50 and the groove 52 is the inner end of a resilient foot pad 54. A similar such foot pad 56 is mounted in conjunction with the sleeve 44. Typical material of construction for the foot pads 54 and 56 would be either rubber or plastic.

Fixedly mounted on a mounting plate 58 is an impaling spike 60. The mounting plate 58 is fixedly mounted within the interior of the leg member 32. A similar such mounting plate and impaling spike are mounted on conjunction with the leg member 30. The impaling spike 60 is located within hollow internal chamber 62 of the foot pad 54. The outer wall of the foot pad 54 includes a hole 64.

Without any weight being applied to the upper end of the ladder 10, the spike 60 is totally confined within the chamber 62 and does not extend exteriorly of the foot pad 54. This keeps the impaling spike 60 from causing any injury to humans or animals or damage to exterior structures prior to usage of the ladder safety attachment. However, when the attachment is mounted so that the foot pads 54 and 56 rest against the vertical wall surface 66 and sufficient weight, as the weight of a person, is applied to the upper end of the ladder 10, the leg members 30 and 32 move inwardly until each impaling spike, such as spike 60, penetrates the wall surface 66 as is clearly shown in FIG. 4 of the drawing. In this position, the coil spring 46 is compressed exerting a bias tending to move the foot pads 54 and 56 toward the position shown in FIG. 3 but are unable to do so because of the weight of the human on the ladder 10 which overcomes the bias of the springs such as spring 46. However, once this weight is removed, the bias of these springs position the impaling spikes, such as spike 60, in the retracted position totally confined within the hollow internal chamber 62 as is clearly shown in FIG. 3 of the drawing.

Referring particularly to FIGS. 5–14 of the drawings, there is shown the second embodiment 68 of ladder safety attachment of this invention. The attachment 68 is to be connected to a conventional ladder 70 which has a plurality of spaced apart rungs 72. The rungs 72 are mounted between side rails 74 and 76 of the ladder 70. The attachment 68 includes a supporting frame in the form of side members 78 and 80. Mounted between the side members 78 and 80 is a hollow tube 82. The portion of the supporting frame which includes the side members 78 and 80 and hollow tubes 82 is located in a single plane in alignment with axis 127. This single plane is to be placed parallel to the longitudinal plane of the ladder 70. The side members 78 and 80 are fixedly secured to the hollow tube 82. The side members 78 and 80 are basically identical in configuration and are positioned in a spaced apart, but aligned position, relative to each other.

Mounted on the side member 78 is a U-shaped plate 77. A similar such U-shaped plate 84 is fixedly mounted on the side member 80. These U-shaped plates 77 and 78 are in transverse alignment and are to function to engage with a rung 72. Generally this rung 72 will be the one that is located directly adjacent the uppermost edge of the ladder 70.

Fixedly mounted on the side member 80 is a similar U-shaped plate 86. The U-shaped plate 86 is similar to the U-shaped plate 84. There will also be a similar such U-shaped plate 79 mounted on the side rail 78 which is also in transverse alignment with the plate 86. The plates 79 and 86 are to be located about another rung 72 of the ladder 70. Connected between the plates 79 and 86 is a connecting rod 88. It is the function of the rod 88 to keep the lower end of the supporting frame of the attachment 68 spaced the same distance apart as the upper portion of the supporting frame.

Figure 14:
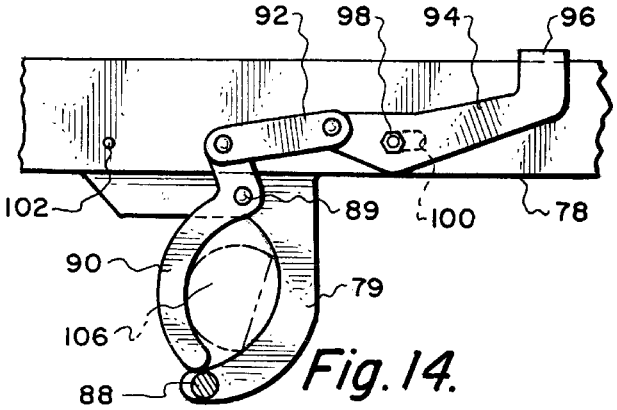
FIG. 14 is a view similar to FIG. 13 but showing the locking device in the position that it would be when mounted in conjunction with a smaller diametered rung of a ladder.

Pivotally mounted on the U-shaped plate 79 by means of a pivot pin 89 is a hook plate 90. The hook plate 90 is adapted to engage one side of the rung 72 with the U-shaped plate 86 engaging the opposite side of the rung 72. The hook plate 90 is pivotally connected to one end of a link 92. The opposite end of the link 92 is pivotally connected to a lever 94. The lever 94 terminates in its outer end in a handle 96. The lever 94 is mounted by means of a fastener 98 to the side member 80. The fastener 98 is mounted within oversized hole 100 formed within lever 94. Connected between the lever 94 and pin 102, which is mounted on the side member 80, is a coil spring 104. The coil spring 104 exerts a continuous bias on the lever 94 tending to locate the lever 94 in the position shown in FIG. 14 of the drawings, that is with the fastener 98 located at the left end of the slot 100. This would be the position of when the attachment 68 is mounted on a ladder with a small diametered rung 106. The rung 106 would be captured between the hook plate 90 and the U-shaped plate 79 thereby securely locking in position the supporting frame of the attachment 68 onto the ladder 70. It is to be understood that there would be a similar type of hook plate (not shown) that would connect with U-shaped plate 86 mounted on the side member 80 that would similarly lock in position on rung 106. Disengagement of the hook plate 90 from the rung 106 is obtained by manually grasping of handle 96 and pivoting of the lever 94 counterclockwise as shown in FIG. 14. This will cause the hook plate 90 to be pivoted clockwise until enough space is provided to permit disengagement from the rung 106. The hook plate (not shown) mounted on the side member 80 would be similarly independently operated to effect this engagement from rung 106.

Figure 13:
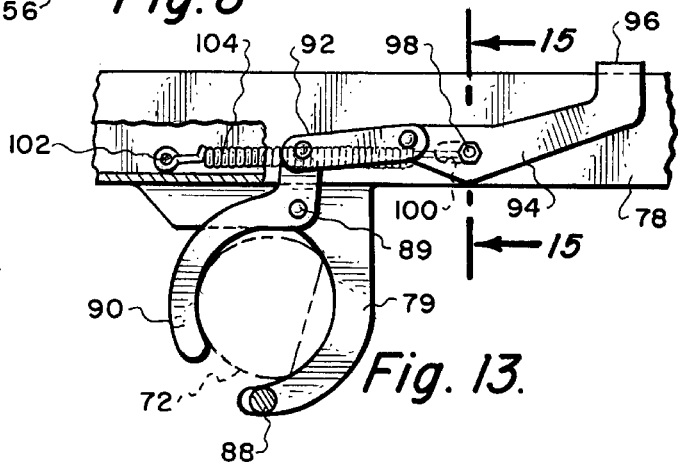
FIG. 13 is a view of the locking device taken along line 13 —13 of FIG. 12 showing the locking device in its position in conjunction with a large diameter rung of the ladder.
Figure 15:
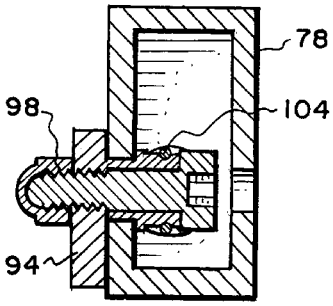
FIG. 15 is a cross-sectional view taken along line 15—15 of FIG. 13.

During engagement of the hook plate 90 about the rung 72, as shown in FIG. 13, where rung 72 is of a larger cross-sectional area than rung 106, the hook plate 90 will be located in a more spaced position from the U-shaped plate 79. This additional spacing requirement is taken up by the elongated slot 100 which positions the lever 94 in a slightly different position when compared to FIG. 14. This different spacing will be against the bias of the coil spring 104.

Conducted through the hollow tube 82 is a main support rod 108. The ends of the main support rod 108 are bent at approximately thirty degrees and mounted within each of the ends is a manually depressible button 110. The button 110 is mounted on a spring member 112 which is located within the confines of the main support tube 108 and actually may be located within the confines of extension tube 114. It is to be understood that there are actually two in number of the extension tubes 114 with each extension tube 114 being connectable with an outer end of the main support tube 108. Each extension tube 114 is to be disengagable from its end of the main support tube 108 for a reason that will be explained further on in the specification.

Mounted within the main support tube 108 is again a pair of buttons 116 which are mounted at each end of a spring member 118. The buttons 116 are each to connect with a hole 120 formed within the hollow tube 82. The buttons 116 are carried by the main support tube 108 and ride against the interior wall surface of the hollow tube 82 until buttons 116 each align with a hole 120. The holes 120 are diametrically located opposite each other. When the buttons 160 connect with the holes 120, the U-shaped frame, composed in part of main support tube 108 and extensions 114, will be in the dotted line position shown in FIG. 6. By manually pressing of the buttons 116 and pivoting of the main support tube 108 from the dotted line position to the solid line position shown in FIG. 6, buttons 122 which are mounted on spring members 124 and which are mounted within the interior of the main support tube 108, then connect with appropriate holes formed within the hollow tube 82. Pivoting of the main support tube 108 occurs about a pivot axis which is central to the hollow tube 82 and located within the plane of the U-shaped frame and also in alignment with axis 127. This will lock the main support tube 108 in the solid line position shown in FIG. 6 in the same manner it was locked in the dotted line position shown in FIG. 6. During usage of the ladder it may be desirable due to the particular ladder construction or because it is not desirable to turn the ladder around, that it would be easier to change the position of the U-shaped frame of the attachment 68 from the solid line position (extending outward from the front of the ladder 70) to the dotted line position (extending outward from the rear of the ladder 70) shown in FIG. 6 and vice versa. This flipping around of this portion of the U-shaped frame amounts to a change in position of 150 degrees of the plane of the U-shaped frame relative to the single plane of the side members 78 and 80 with it normally being assumed that the ladder 70 would be located at about a fifteen degree angle relative to the vertical wall surface 126. Each position of the U-shaped frame forms a seventy-five degree angle relative to the single plane of the side members 78 and 80. There are also intermediate holes located within hollow tube 82 located between the aforementioned holes. When the buttons 116 are engaged with the intermediate holes, the plane of the U-shaped frame is aligned with the single plane of the side members 78 and 80. It is desirable to locate the U-shaped frame in this aligned position during transporting of the second embodiment 68. This locates the second embodiment 68 in a position occupying the least space facilitating portability. It is understood that the U-shaped frame is locked in this aligned position.

Mounted within each extension 114 is an inner tube 128 with it being understood there are two separate inner tubes 128. Inner tubes 128 are part of the U-shaped frame. Included within each inner tube 128 is a pair of buttons 130 each of which are mounted on a spring member 132. The buttons 130 are connectable with either holes 133, 134 or holes 136 located within each extension tube 114. When buttons 130 connect with the holes 136, the inner tube 128 protrudes the least distance from the extension tube 114. When the buttons 130 connect with the holes 133, the inner tube 128 protrudes the greatest distance from the extension tube 114. Therefore, the attachment 68 will be a smaller width when the buttons 130 are connected with the holes 136 and of greater width when connected with the holes 133. When the buttons 130 connect with the holes 134, an intermediate width is obtained.

Figure 7:
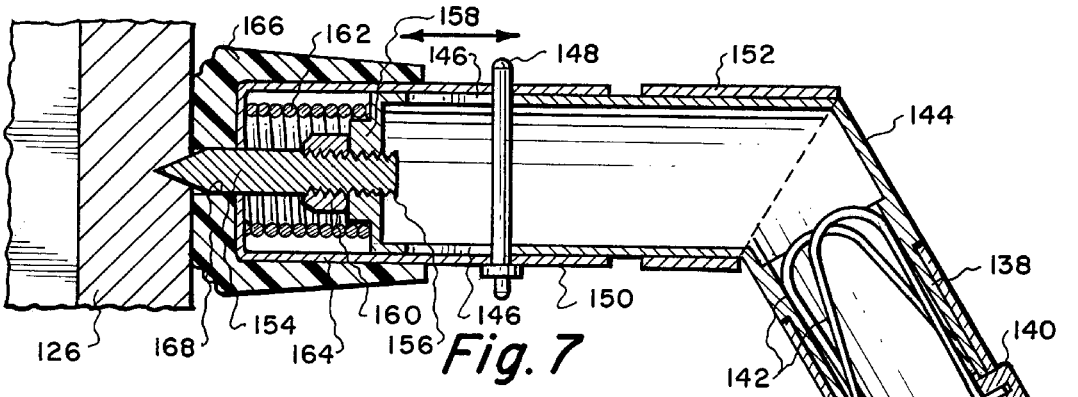
FIG. 7 is an enlarged cross-sectional view through one of one of the foot pad sections of a second embodiment of ladder safety attachment of the present invention taken along line 7—7 of FIG. 6 showing the impaling spike in the extended position and penetrating the vertical wall surface.
Figure 8:
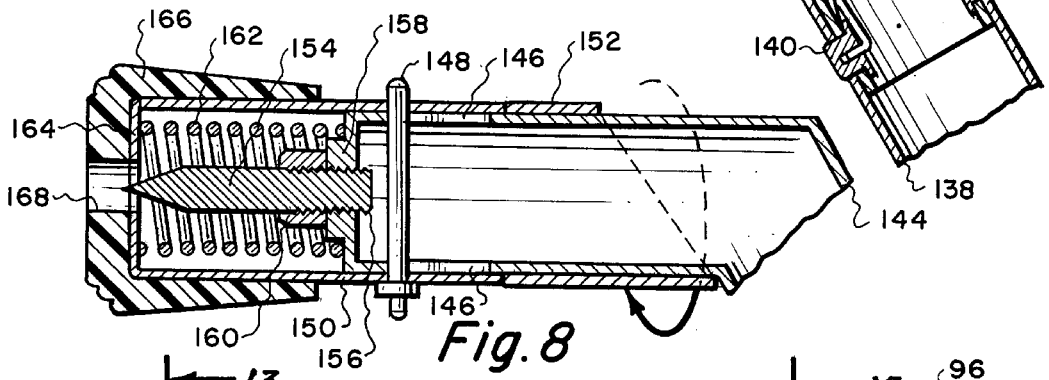
FIG. 8 is a view similar to FIG. 7 but showing the impaling spike in the retracted position not in contact with the vertical wall surface.
Figure 12:
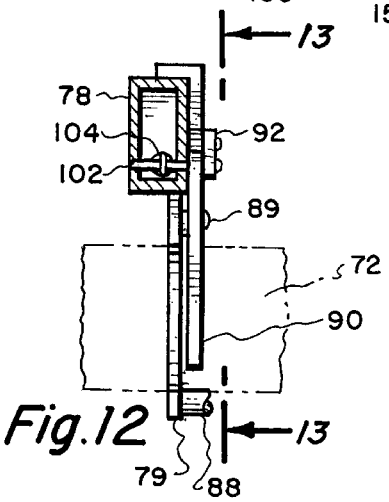
FIG. 12 is a bottom plan view through one of the locking devices that is utilized with the second embodiment of the ladder attachment of the present invention that is utilized to lock the ladder attachment to a rung of the ladder taken along line 12— of FIG. 6.

A sleeve 138 is to be locatable within each inner tube 128 with it being understood that there are two in number of sleeves 138 which are also part of the U-shaped frame. Mounted within each sleeve 138 is again a pair of buttons 140 each of which are mounted on a spring member 142. The buttons 140 are to be connectable with appropriate holes formed within its respective inner tube 128 so as to lock each sleeve 138 in position on its respective inner tube 128. Each sleeve 138 is integral with a sixty degree angled tube 144 with it being understood there are two separate tubes 144 which are also part of the U-shaped frame. Formed within each sixty degree angled tube 144 is a pair of diametrically aligned elongated slots 146. Connecting between the slots 146 is a pin 148. The pin 148 is fixedly mounted onto a foot tube 150 with there being two separate foot tubes 150 which are also part of the U-shaped frame. Each foot tube 150 is longitudinally slidingly movable onto a sixty degree angled tube 144 with the longitudinal extent of the movement being determined by the pin 148 sliding within the confines of slots 146. A locking sleeve 152 is movably mounted in a close confining manner on the sixty degree angled tube 144 with the locking sleeve 152 assuming a slanted configuration which in one position aligns with the sixty degree angle of the tube 144 as is shown in FIG. 7. When in FIG. 7, this permits the pin 148 to move within the confines of the slots 146 which will then permit the impaling device 154 in the form of a spike to penetrate the vertical wall surface 126. However, if it is desired to not have the impaling device 146 to penetrate the wall surface 126, the user can pivot the locking sleeve 152 one hundred and eighty degrees to the position shown in FIG. 8 which will locate the locking sleeve 152 in the position that locates the pin 148 at the outer end of the slots 146. The longest dimension of the sleeve 152 will abut against the section of the tube 144 that is bent at sixty degrees thereby functioning as a stop for any longitudinal movement of the foot tube 150. This will prevent the impaling devices 154 from penetrating the vertical wall surface 126. In other words, with the attachment shown in FIGS. 5–14, usage of the impaling devices 154 can be made optional by the user. Also, during transporting of the attachment 68, it would normally be desirable to locate the impaling devices 154 in their retracted position as shown in FIG. 8 to thereby minimize the possibility of any injury upon protruding.

Each impaling device 154 is adjustably mounted by a threaded section 156 within the outer end 158 of a sixty degree angled tube 144. The amount of extension of the impaling device 154 can be adjusted by the position of a nut 160 which is mounted on the threaded section 156. Surrounding the impaling device 154 and the nut 160 is a coil spring 162 with there being two separate coil springs 162. Each coil spring 162 is mounted within the interior of a foot tube 150. One end of each coil spring 162 rests against the outer end 164 of a foot tube 150 with the opposite end of the coil spring 162 resting against the closed end 158 of the sixty degree angled tube 144. It is the bias of the springs 162 that tends to locate the impaling devices 154 in the retracted position shown in FIG. 8 with the foot tubes 150 in the extended position. Surrounding the outer end of each foot tube 150 is a resilient foot pad 166 with there being two separate foot pads 166. Each foot tube 150 and its respective foot pad 166 is defined as a foot pad section. Centrally located within each resilient foot pad 166 is a hole 168. Each impaling device 154 is to extend through a hole 168 when it penetrates the vertical wall surface 126. When sufficient amount of pressure is applied on the ladder 70, usually by means of the weight of the human located on the ladder 70, the coil springs 162 will be compressed, the foot tubes 150 retracted and the impaling devices 154 will be moved to the extended position shown in FIG. 7 and will then slightly penetrate the vertical wall surface 126.

Each impaling device is centrally mounted within its respective foot pad 166. This permits each impaling device 154 to be hidden from view and not physically contactable when each foot pad section is in the retracted position preventing any possible injury by the impaling devices when retracted. Impaling devices of the prior art comprise an annular collar with the outer circular edge being serrated. This type of impaling device would not work for the present invention since it would noticeably mar the surface on which it is placed. No one would want to use an impaling device that required repair each time the attachment was used.

Most extension ladders that are being manufactured at this time are known as "front throw". This means that the extendible section is located further from the wall surface where the ladder is to be used than the fixed section. It is desirable to attach the attachment with the ladder in a horizontal position (normally on the ground or floor). It is not possible to connect an attachment of the prior art with a "front throw" ladder horizontal. The reason for this is that the extending legs of the attachment would interfere with the ground or floor requiring that the ladder be raised to install the attachment. With the present invention, the attachment can be installed with the ladder located horizontally since the legs can be adjusted to be aligned with the body of the attachment thereby not interfering with the ground or floor.

What is claimed is:

1. In combination with a ladder, said ladder having a pair of spaced apart side rails which are connected together by a plurality of spaced apart rungs, said rungs being parallel to each other, said ladder defining a longitudinal plane, a ladder safety attachment comprising:

a supporting frame mounted onto directly adjacent said rungs, said supporting frame being located in a first plane, said first plane located parallel to and directly adjacent said longitudinal plane, said first plane having a front side defined as the space on one side of said first plane, said first plane having a rear side defined as the space on the opposing side of first plane;

a U-shaped frame pivotally mounted on said supporting frame, said U-shaped frame being located within a second plane, said U-shaped frame having a pair of spaced apart foot pad sections, each said foot pad section including a single impaling device, each said impaling device being positionable in either an extended position or a retracted position relative to its respective said foot pad section, with a said impaling device in said extended position said impaling device being available to penetrate a vertical wall surface against which the ladder is braced, each said foot pad section being retractable so as to locate its respective said impaling device in said extended position upon sufficient force being applied against said foot pad section in a direction toward a vertical wall surface, with each said impaling device in said retracted position said impaling device being hidden preventing injury and damage due to inadvertent contact with said impaling device between a human or an inanimate object; and said U-shaped frame being pivotable about a pivot axis relative to said supporting frame between a forwardly extending position and a rearwardly extending position, said pivot axis being located within both said first plane and said second plane, said forwardly extending position substantially totally locating said U-shaped frame within said front side, said rearwardly extending position substantially totally locating said U-shaped frame within said rear side, said U-shaped frame being lockable in both said forwardly extending position and said rearwardly extending position.

2. The combination as defined in claim 1 wherein:

said U-shaped frame being pivotable approximately 150 degrees between said forwardly extending position and said rearwardly extending position.

3. The combination as defined in claim 1 wherein:

both said forwardly extending position and said rearwardly extending position will form the same angle with said first plane.

4. The combination as defined in claim 1 wherein:

said U-shaped frame being fixable in position relative to said supporting frame with said second plane being in alignment with said first plane.

5. The combination as defined in claim 1 wherein:

said supporting frame including a locking device, said locking device is adapted to be locked onto a rung of a ladder.

6. The combination as defined in claim 5 wherein:

said locking device being adjustable so as to accommodate to different thicknesses of rungs.

* * * * *